US010012487B2

(12) United States Patent
Isaacson

(10) Patent No.: US 10,012,487 B2
(45) Date of Patent: Jul. 3, 2018

(54) TRACKING ARROW

(71) Applicant: Jessica Mikeale Isaacson, Pelzer, SC (US)

(72) Inventor: Jessica Mikeale Isaacson, Pelzer, SC (US)

( * ) Notice: Subject to any disclaimer, the term of this patent is extended or adjusted under 35 U.S.C. 154(b) by 0 days.

(21) Appl. No.: 15/530,133

(22) Filed: Dec. 5, 2016

(65) Prior Publication Data

US 2017/0160064 A1 Jun. 8, 2017

Related U.S. Application Data

(60) Provisional application No. 62/386,639, filed on Dec. 7, 2015.

(51) Int. Cl.

| | |
|---|---|
| ***F42B 12/36*** | (2006.01) |
| ***F42B 6/04*** | (2006.01) |
| ***F42B 12/46*** | (2006.01) |
| ***F42B 12/40*** | (2006.01) |

(52) U.S. Cl.

CPC ..... *F42B 12/362* (2013.01); *F42B 6/04* (2013.01); *F42B 12/40* (2013.01); *F42B 12/46* (2013.01)

(58) Field of Classification Search

CPC .. F42B 6/04; F42B 6/08; F42B 12/362; F42B 12/40; F42B 12/46

USPC ..... 473/577, 578, 581

See application file for complete search history.

(56) References Cited

U.S. PATENT DOCUMENTS

| | | | | | |
|---|---|---|---|---|---|
| 3,066,940 | A * | 12/1962 | De Lonais | F42B 12/54 | 473/581 |
| 3,565,435 | A * | 2/1971 | Bear | F42B 12/54 | 102/512 |
| 3,572,716 | A * | 3/1971 | Bear | F42B 12/54 | 473/577 |
| 3,893,866 | A * | 7/1975 | Hollingsworth | F42B 12/54 | 102/512 |
| 4,463,953 | A * | 8/1984 | Jordan | F42B 12/54 | 473/581 |
| 5,035,435 | A * | 7/1991 | Burgeson | F42B 6/04 | 239/34 |
| 5,183,259 | A * | 2/1993 | Lyon | F42B 6/04 | 239/37 |
| 5,295,692 | A * | 3/1994 | Wright | F42B 6/04 | 473/578 |
| 5,303,496 | A * | 4/1994 | Kowalkowski | F42B 12/36 | 124/54 |
| 5,836,842 | A * | 11/1998 | McLearan | F42B 6/04 | 473/581 |
| 6,059,677 | A * | 5/2000 | Breshears | F42B 6/04 | 473/581 |

(Continued)

*Primary Examiner* — Alexander Niconovich
(74) *Attorney, Agent, or Firm* — Timothy S. Stevens; Karen L. Kimble

(57) ABSTRACT

A method for converting an ordinary hunting arrowhead into an arrowhead that can be used to track a game animal wounded by the converted arrowhead. The method includes the steps of filling a frangible container with riboflavin powder and then attaching the container to the tip of the arrowhead to produce the converted arrowhead so that if the converted arrowhead is fired at and hits a game animal to wound the game animal, the frangible container can break so that the riboflavin powder is distributed into an environment where said animal was hit and into any blood flowing from said wound to better enable the tracking of the wounded animal.

1 Claim, 2 Drawing Sheets

(56) References Cited

U.S. PATENT DOCUMENTS

| | | | | |
|---|---|---|---|---|
| 6,186,913 | B1 * | 2/2001 | Thomas | F42B 12/362 473/581 |
| 6,450,905 | B1 * | 9/2002 | Edlund | F42B 6/04 239/145 |
| 7,488,267 | B2 | 2/2009 | Hunt | |
| 7,601,084 | B2 * | 10/2009 | Martin | F42B 6/02 473/578 |
| 8,444,512 | B2 * | 5/2013 | Pierce | A61L 9/12 473/578 |
| 9,205,164 | B2 * | 12/2015 | Sanazaro | F42B 6/08 |
| 9,335,136 | B1 * | 5/2016 | Campbell | F42B 6/04 |
| 9,784,542 | B1 * | 10/2017 | McMillan | F42B 12/362 |
| 2006/0014598 | A1 * | 1/2006 | Martin | F42B 6/08 473/578 |
| 2006/0189420 | A1 * | 8/2006 | Hunt | F42B 6/04 473/578 |
| 2008/0234078 | A1 * | 9/2008 | Eyerman | F42B 12/362 473/581 |

* cited by examiner

TRACKING ARROW

The instant invention relates to tracking arrows for bow hunting game animals. This application claims priority to U.S. Provisional Patent Application Ser. No. 62/386,639 filed Dec. 7, 2015.

BACKGROUND OF THE INVENTION

As discussed in U.S. Pat. No. 7,488,267, when hunting wild game, hunters aim for a quick and clean kill that puts the animal down with little suffering. However, when bow hunting even when the animal is mortally wounded the animal will probably flee for a time before bleeding out and dying. When a game animal has been wounded but flees, it can be very difficult to track. Even during the day, the animal's blood can be difficult to see, for example, on leaves, the bare ground, etc. The problem is compounded during low light conditions, i.e., at night, in early morning, and in late afternoon. No bow hunter wants to lose an animal he or she has wounded because the animal's blood trail could not be tracked. U.S. Pat. No. 7,488,267 disclosed a number of devices and methods comprising fluorescent agents for tracking wounded game animals. However, the devices disclosed are cumbersome and costly. And, the fluorescent agents disclosed are toxic chemicals. Thus it can be seen that there is a need in the bow hunting art for improvements to devices and methods for tracking wounded game animals. It is to such improvements that the instant invention is directed.

SUMMARY OF THE INVENTION

The instant invention is an important advance in the art of tracking devices and methods for bow hunters. More specifically, the instant invention is a frangible container to be attached to the tip of an arrowhead, the container defining an enclosed space within the container, the enclosed space comprising riboflavin so that when the container is attached to the tip of an arrow and the arrow is fired at and hits a game animal to wound the game animal, the frangible container breaks so that the riboflavin is distributed into the environment where the animal was hit and into the blood flowing from the wound so that the environment where the animal was hit and the blood trail from the blood flowing from the wound can be more readily detected by directing light having a wavelength in the range of from about 300 to about 500 nanometers to observe the resulting florescence of the riboflavin in the environment where the animal was hit and in the blood trail. The frangible container is preferably a gelatin capsule. Preferably the gelatin capsule is coated with a water resistant coating.

The instant invention is also the combination of a hunting arrowhead and a container of the preceding paragraph wherein the container is attached to the tip of the arrowhead or within the arrowhead.

The instant invention is also bow a hunting method for wounding and tracking a game animal, comprising the steps of: (a) firing the combination of the preceding paragraph at a game animal to hit the game animal to wound the game animal, the frangible container breaking so that the riboflavin is distributed into the environment where the animal was hit and into the blood flowing from the wound; (b) directing light having a wavelength in the range of from about 300 to about 500 nanometers around the environment where the animal was hit to observe the resulting florescence of the riboflavin in the environment where the animal was hit; and (c) directing light having a wavelength in the range of from about 300 to about 500 nanometers onto any suspected blood trail so that the blood trail from the blood flowing from the wound can be more readily detected by the resulting florescence of the riboflavin in the blood trail.

DETAILED DESCRIPTION OF THE INVENTION

In one embodiment, the instant invention is a frangible container to be attached to the tip of an arrowhead, the container defining an enclosed space within the container, the enclosed space comprising riboflavin so that when the container is attached to the tip of an arrowhead and the arrowhead is fired at and hits a game animal to wound the game animal, the frangible container breaks so that the riboflavin is distributed into the environment where the animal was hit and into the blood flowing from the wound so that the environment where the animal was hit and the blood trail from the blood flowing from the wound can be more readily detected by directing light having a wavelength in the range of from about 300 to about 500 nanometers to observe the resulting florescence of the riboflavin in the environment where the animal was hit and in the blood trail. Any suitable frangible container can be used such as a container made of onion skin paper, glassine paper, cellophane or the like or a gelatin capsule or the like. Gelatin capsules (such as a 000 size gelatin capsule) are readily available and easily filled with riboflavin powder. When a gelatin capsule is used, it is preferable that it be coated with a water resistant coating such as a polymer coating or a coating of lacquer or shellac. Polymer based water resistant coatings are commercially available such as KOLLICOAT brand gelatin capsule coating from BASF Corp., Tarrytown, N.Y. Light sources (some of which are available in a form similar to a common LED flashlight) emitting light in the wavelength range of from about 300 to about 500 nanometers are readily available as "black lights", "tracking lights", "forensic lights", "pet urine lights" etc.

In the use of the embodiment of the preceding paragraph, the tip of an arrowhead is combined with a frangible container of the instant invention, which combination is fired at a game animal to hit the game animal to wound the game animal, the frangible container breaking so that the riboflavin is distributed into the environment where the animal was hit and into the blood flowing from the wound. Light having a wavelength in the range of from about 300 to about 500 nanometers is directed around the environment where the animal was hit to observe the resulting florescence of the riboflavin in said environment. Directing light having a wavelength in the range of from about 300 to about 500 nanometers onto any suspected blood trail makes such a blood trail from the blood flowing from the wound can be more readily detected by the resulting florescence of the riboflavin in the blood trail. An additional benefit of the instant invention is that if the arrowhead passes through the game animal, the arrowhead carries a portion of the riboflavin with the arrowhead and is more easily observed and recovered. It is important to note that riboflavin is not a toxic chemical and will not make meat unsafe to eat.

Figure 1:
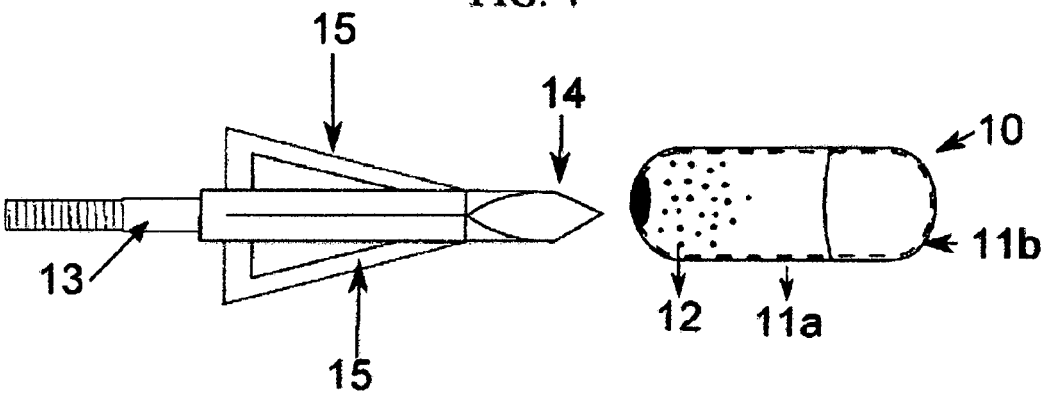
FIG. 1 depicts a highly preferred frangible container of the instant invention in front of a broad head arrowhead.

Referring now to FIG. 1, therein is shown a frangible container 10 of the instant invention in the form of gelatin capsule cap 11*b*, gelatin capsule body 11*a* and riboflavin powder 12. Broadhead arrow point 13 having blades 15 and tip 14 is shown in front of one end of frangible container 10 in position to insert tip 14 into container 10.

Figure 2:
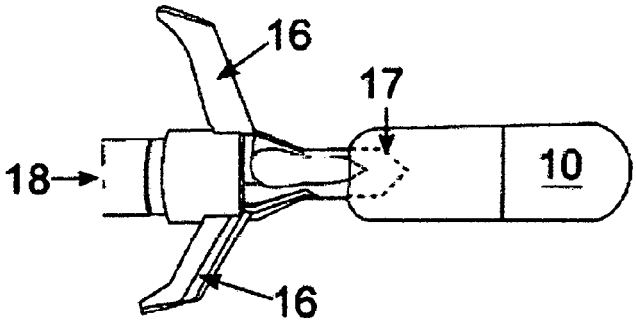
FIG. 2 depicts the tip of a mechanical broad head arrowhead inserted into one end of the container of FIG. 1, the blades of the mechanical broad head arrow point shown in the deployed position.

Referring now to FIG. 2, therein is shown the tip 17 of a mechanical broad head arrow point 18 inserted into one end of the container 10 of FIG. 1, the blades 16 of the mechanical broad head arrow point 18 shown in the deployed position.

Figure 3:
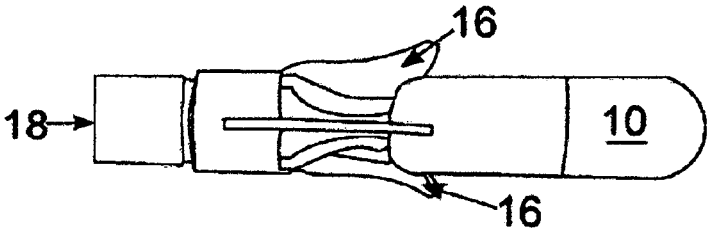
FIG. 3 depicts the combination shown in FIG. 2 with the blades of the mechanical broad head arrow point shown in their folded position.

Referring now to FIG. 3, therein is shown the combination shown in FIG. 2 with the blades 16 of the mechanical broad head arrow point 18 shown in their folded position.

Figure 4:
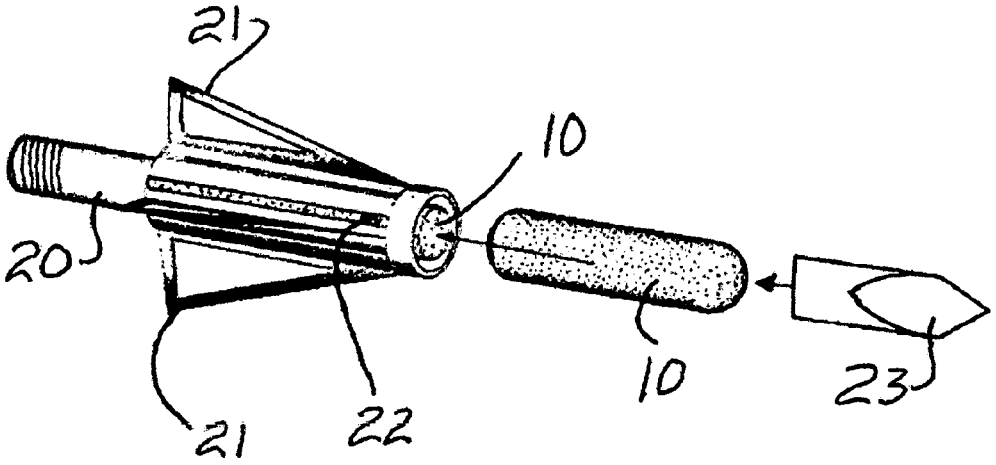
FIG. 4 depicts a frangible container of the instant invention positioned within a broad head arrowhead.

Referring now to FIG. 4, therein is shown a frangible container 10 of the instant invention positioned within a broad head arrowhead 20. The broadhead arrow head 20 has fixed blades 21, a hollow body into which frangible container 10 is inserted as shown followed by plunder tip 23. Broadhead arrowhead 20 has an elongated aperture 22 therethrough to expose container 10. Arrowhead tip 23 is fitted into the end of arrowhead 20. When arrowhead 20 is fired at a game animal to hit the game animal to wound the game animal, the rear of tip 23 is rammed into the front of frangible container 10 to break container 10 at aperture 22 so that the riboflavin is distributed through aperture 22 into the environment where the animal was hit and into the blood flowing from the wound. Light having a wavelength in the range of from about 300 to about 500 nanometers is directed around the environment where the animal was hit to observe the resulting florescence of the riboflavin in said environment. Directing light having a wavelength in the range of from about 300 to about 500 nanometers onto any suspected blood trail makes such a blood trail from the blood flowing from the wound can be more readily detected by the resulting florescence of the riboflavin in the blood trail. An additional benefit of the instant invention is that if the arrowhead 20 passes through the game animal, arrowhead 20 carries a portion of the riboflavin with arrowhead 20 and is more easily observed and recovered. Again, it is important to note that riboflavin is not a toxic chemical and will not make meat unsafe to eat.

CONCLUSION

While the instant invention has been described above and claimed below according to its preferred embodiments, it can be modified within the spirit and scope of this disclosure. This application is therefore intended to cover any variations, uses, or adaptations of the instant invention using the general principles disclosed herein. Further, the instant application is intended to cover such departures from the present disclosure as come within the known or customary practice in the art to which this invention pertains.

What is claimed is:

1. A method for altering an arrowhead, the arrowhead having a tip, the tip being sharpened the method comprising the steps of (a) filling a frangible container with riboflavin powder; and (b) inserting the frangible container on a forwardmost portion of the tip of the arrowhead so that if the altered arrowhead is fired at and hits a game animal to wound the game animal, the frangible container is the initial contact point with the game animal so that the frangible container is ruptured by the sharpened tip so that the riboflavin powder is distributed into an environment where said animal was hit and into any blood flowing from said wound so that said environment where said animal was hit and any blood trail from any blood flowing from said wound can be more readily detected by directing light having a wavelength in the range of from about 300 to about 500 nanometers to observe a florescence of said riboflavin powder in said environment where said animal was hit and in any said blood trail.

* * * * *